United States Patent [19]

Little

[11] 3,950,819

[45] Apr. 20, 1976

[54] LID COUNTER-BALANCE MECHANISM

[75] Inventor: Carl H. Little, Jamestown, N.Y.

[73] Assignee: Weber-Knapp Company, Jamestown, N.Y.

[22] Filed: Jan. 16, 1975

[21] Appl. No.: 541,612

[52] U.S. Cl. ..... 16/190; 16/85

[51] Int. Cl.[2] ..... E05F 1/12

[58] Field of Search ..... 16/190, 185 H, 180, 16/141, 142, 145, 85

[56] References Cited

UNITED STATES PATENTS 3,457,584 7/1969 Phelps ..... 16/190

3,737,947 6/1973 Little ..... 16/145

*Primary Examiner*—Andrew V. Kundrat

*Attorney, Agent, or Firm*—Bean & Bean

[57] ABSTRACT

A counterbalance mechanism features a single stationary bracket, which serves as a free pivotal and thrust bearing support for a counterbalance assembly extending through the bracket for connection to a lid operating linkage.

4 Claims, 4 Drawing Figures

10
12
14
16
18
20
22
24
26
30
32
34
36
36a
42b
44
46
50a
50b
50c
50d
52
52a
54
58a
60

3
3
10
14
32
34
36
36a
38
42a
42b
46
50a
50b
50c
50d
52
54
56
58a
60
62
64
68

LID COUNTER-BALANCE MECHANISM

SUMMARY OF THE INVENTION

A counterbalance mechanism has been designed for accomodation within a constricted area of a cabinet for which it is not suitable to employ an externally mounted mechanism of the type described for instance in U.S. Pat. No. 3,457,584.

The present mechanism features the provision of a single stationary mounting bracket, which is suitably fixed within the confines of a cabinet and serves to provide free pivotal and thrust bearing support for a counterbalance assembly arranged to extend through the bracket for connection to a suitable lid operating linkage.

The present mechanism possesses a size advantage permitting it to be mounted within an elongated, but cross-sectionally small area of the cabinet, as well as the advantages of structural simplicity.

DRAWINGS

DETAILED DESCRIPTION

Figure 1:
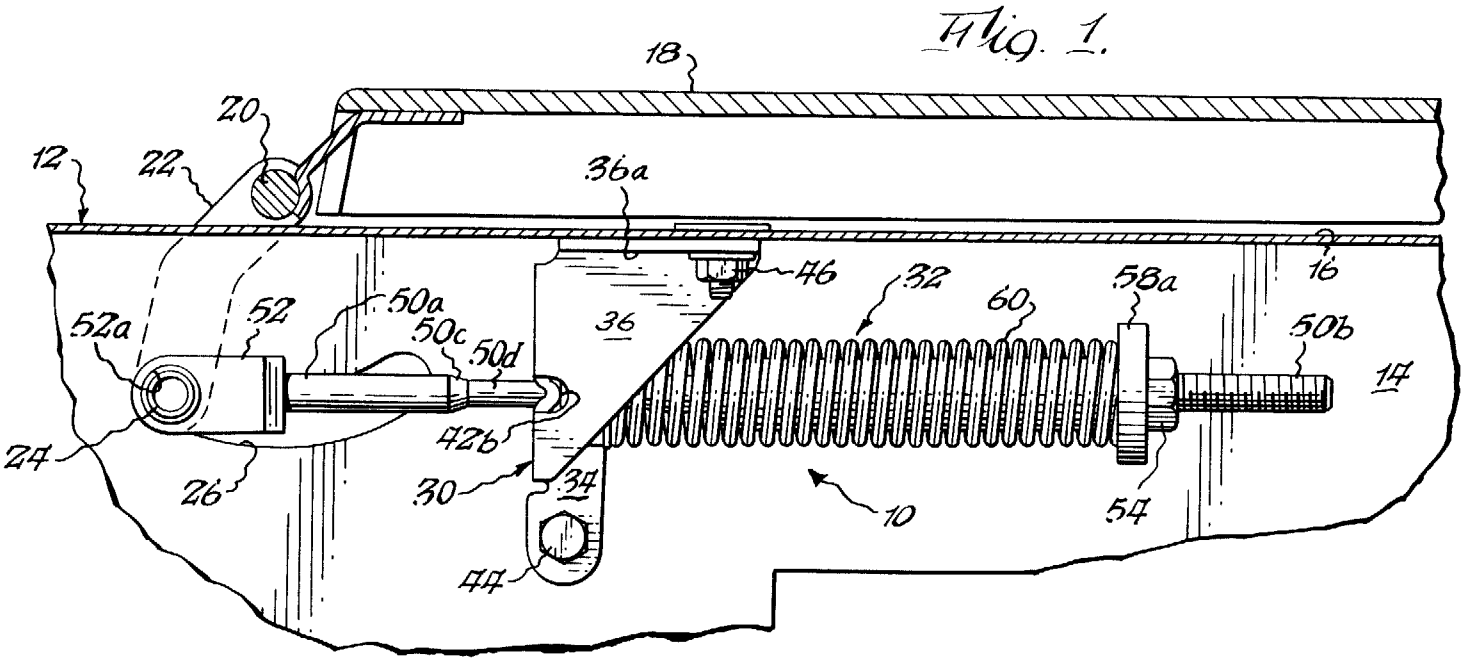
FIG. 1 is a side elevational view of a lid counter-balance mechanism of the present invention shown with adjacent cabinet parts.
Figure 2:
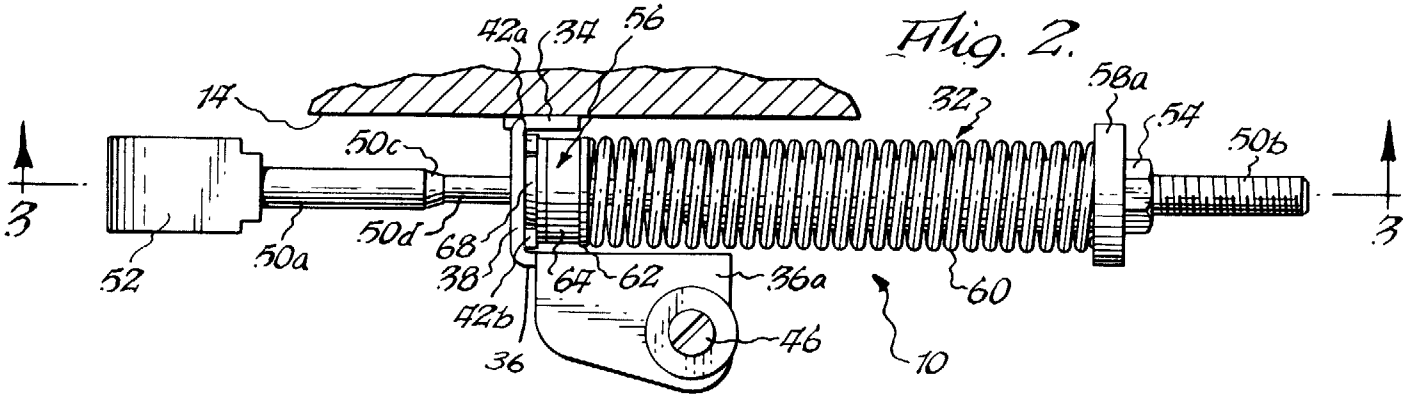
FIG. 2 is a top-plan view thereof.

Reference is now made particularly to FIGS. 1 and 2, wherein the mechanism of the present invention is generally designated as 10, and shown as being mounted within a cabinet 12 in a relatively confined or cross-sectionally small space bounded by a side wall portion 14, a top-edge wall portion 16 and mechanism, not shown, which the cabinet is designed to house.

Figure 3:
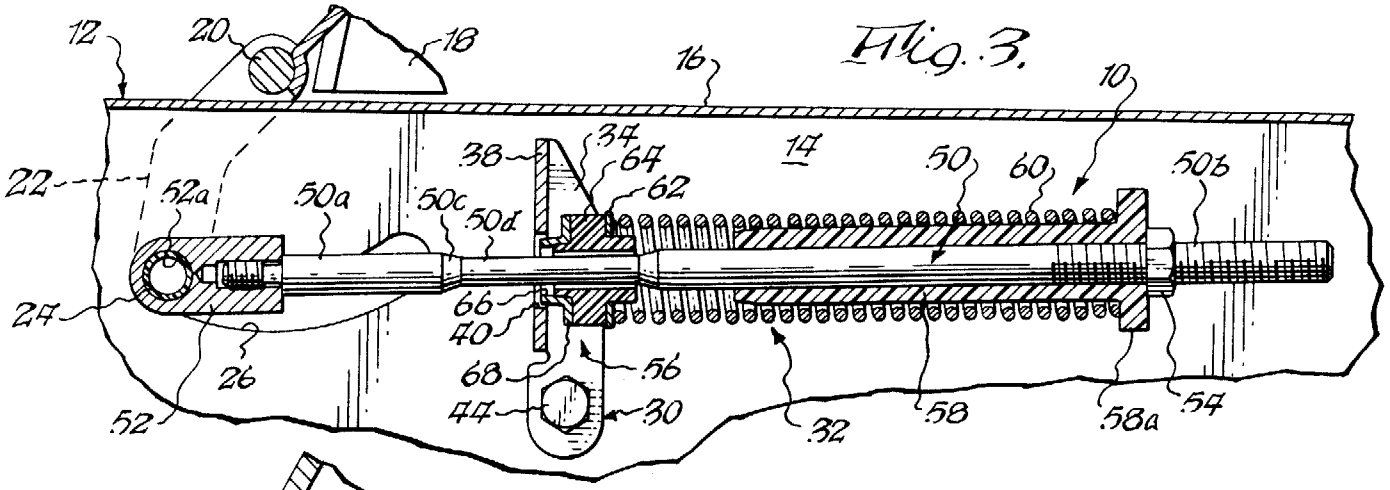
FIG. 3 is a sectional view taken generally along line 3—3 in FIG. 2 and showing the mechanism in lid closed condition.
Figure 4:
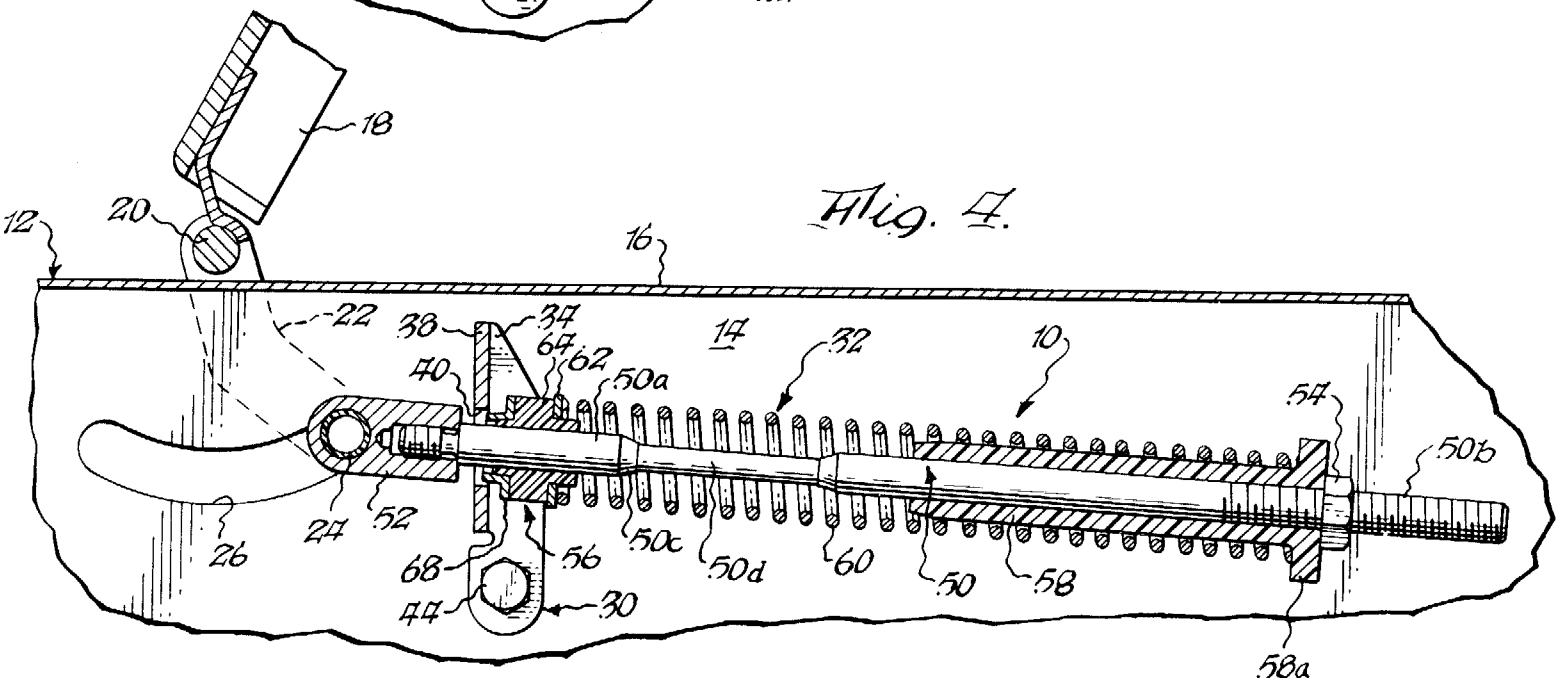
FIG. 4 is a view similar to FIG. 3, but showing the mechanism in lid open condition.

In the illustrated construction of cabinet 12, a lid 18 is rigidly fixed to a hinge pin or shaft 20, which is suitably journalled to permit vertically swinging movements of the lid between essentially horizontally and vertically disclosed closed and open positions, which are shown in FIGS. 3 and 4 respectively as being spaced through approximately 70°. Hinge pin 20 is coupled to mechanism 10 by means of an external linkage arm 22, which is rigidly fixed to extend radially from the hinge pin and carries coupling means in the form of a pivot pin connector 24 adjacent its free or radially outer end; pin connector 24 in turn freely extending into the cabinet through an arcuate slot 26 formed in side wall portion 14 for connection with mechanism 10 in the manner to be described. The present invention is not limited to the illustrated mode of mounting lid 18 on cabinet 12 and interconnecting mechanism 10 to lid 18; it being uderstood that mechanism 10 will function in the manner to be described so long as pivot pin 24 or other suitable mechanism connector is permitted to move along an arcuate path relative to the axis about which the lid swings in order to permit the development of lid counterbalance torque.

Mechanism 10 generally comprises a single stationary bracket 30, and a counterbalance assembly 32. Bracket 30 is of generally U-shaped construction including a pair of essentially parallel leg portions 34 and 36 joined by a base portion 38. Further, leg portion 36 is formed with a right-angularly extending flange 36a, and base portion 38 is formed with a through opening 40 and bearing means in the form of a pair of "punched-out" ears **42*a*, 42*b* disposed immediately adjacent horizontally opposite sides of opening 40. Bracket 30 may be rigidly fixed within cabinet 12 by any suitable means, such as by a fastener device 44 extending through leg portion 34 into side wall portion 14 and a fastener device 46 extending through flange 36*a* into top wall portion 16**.

Assembly 32 is best shown in FIGS. 2 and 3 as including a bolt 50, which has its first and second or opposite end portions **50*a* and 50*b* threadably or otherwise suitably attached to a connector 52 and an abutment preferably in the form of an adjustment nut 54, respectively; a friction brake/mounting assembly 56, which is disposed concentrically of bolt 50 and arranged in bearing engagement with ears 42*a* and 42*b*; a spacer sleeve 58, which is formed with an annular end enlargement or flange 58*a* and internally dimensioned to slideably receive bolt end portion 50*b*; and a compression spring 60, which is disposed concentrically of bolt 50 and sleeve 58 with its opposite ends arranged in bearing engagement with assembly 56 and sleeve enlargement 58*a*. Connector 52 is formed with a through bore opening 52*a* for receiving pivot pin 24 whose axis is disposed transversely of the axis of bolt 50 and parallel to the axis of hinge pin 20**.

Assembly 56 is similar in construction and mode of operation to that described in U.S. Pat. No. 3,457,584 in that the assembly includes a bearing washer 62 arranged in engagement with one end of a resiliently deformable sleeve-shaped friction brake shoe or snubber 64, whose opposite end is received within a through bore opening 66 of a conically shaped bearing member 68. However, in accordance with the present invention, member 68 is positionally located within opening 40 and arranged in bearing engagement with ears **42*a* and 42*b* to permit vertical pivotal or tilting movements thereof about an ear defined "tilt" axis disposed essentially parallel to the axis of connector bore opening 52*a*. This mode of supporting member 68 accommodates mechanism 10 to follow arcuate movements of pivot pin 24 about the axis of hinge pin 20 during vertical swinging movements of lid 18**.

In the illustrated construction, bolt 50 is of a stepped-diameter construction similar to that described in U.S. Pat. No. 3,457,584 to degrees. lid 18 to "pop-up" from its closed position when a suitable holding latch, not shown, is released. Specifically, bolt 50 is shown as being bevel-shouldered down from large diameter end portion **50*a***, as indicated at 50*c*, to a reduced diameter central portion **50*d*; shoulder 50*c* being positioned axially of the bolt such that portion 50*d* is disposed in radial alignment with assembly 56 during the lowermost segment of the arc of lid opening movements, as for instance through lid angles of between about zero and thirty degress. The diameter of portion 50*d* is sufficiently small to prevent frictional braking or motion snubbing engagement thereof with brake shoe 64 during axial displacements of portion 50*d* relative to assembly 56, whereas the diameter of portion 50*a* is sufficiently large to insure friction braking engagement with the brake shoe in the manner to be described. It will be noted that the above described tiltable support afforded member 68 by bracket ears 42*a* and 42*b* permits spring 60 and thus the force exerted thereby to remain in axial alignment with bolt 50 even for lid positions in which bolt portion 50***d* is radially aligned with brake shoe 64. The opposite end portion 50*b* of bolt 50 is shown as having a diameter corresponding to that of end portion 50*a*, but the diameter of this portion of the bolt is not critical, as are the diameters of portions 50*a* and 50*d*, since it is not positioned in radial alignment or cooperative engagement with assembly 56 during opening and closing movements of lid 18.

The parts of mechanism 10 are so dimensioned and arranged that when lid 18 is down or closed, as shown in FIGS. 1 and 3, bolt 50 is pulled through bracket opening 40 towards the left, whereby to maintain some minimum spacing between spacer sleeve flange 58*a* and assembly 56 or bracket 30 and thus subject spring 60 to maximum compression. In other words, when lid 18 is closed, spring 60 exerts a maximum force tending to "push" bolt 50 to the right and this force acting through pivot pin 24 and link 22 creates a moment tending to counterbalance the torque effects of gravity acting on the lid about the axis of hinge pin 20.

As lid 18 swings upwardly from its closed position, pivot pin 24 swings in an arch about the axis of hinge pin 20 towards bracket 30 with the result that spacer sleeve flange 58*a* is permitted to move away from bracket 30 and spring 60 is permitted to relax and reduce the force being applied by the spring for counterbalancing the gravity forces on the lid. However, the construction of mechanism 10 is such that the counterbalancing effects produced by the progressively reduced spring force is effective to generally compensate for or balance the torque effects of gravity acting on the lid, which also progressively decreases as the lid is swung upwardly into its fully open position.

When the lid reaches its fully open position shown in FIG. 4, the distance between spacer sleeve flange 58*a* and bracket 30 is maximum, and thus the spring force acting on pivot pin 24 is minimum. It will be understood that the friction braking effects produced by sliding frictional engagement of brake shoe 64 with bolt portion 50*a* will vary directly with spring pressure and are opposite in direction to the direction of movement of lid 18, that is, friction braking effects oppose movement of the lid towards both open and closed position. Thus, when operative, the friction braking effects either oppose or supplement spring force effects so as to establish a counterbalance envelope bounded by spring force induced torque plus or minus friction braking induced torque. When the gravity induced lid torque has a value falling within this envelope, the lid is counterbalanced. When lid torque has values below and above the envelope, the lid is forced by the spring to move towards open position or forced by gravity to move towards closed position, respectively. Adjustments of nut 54 lengthwise of bolt portion 50*b* serves to vary the spring force/friction braking counterbalancing effects throughout the range of lid swinging movements, as required to accommodate for lids of different weights and/or "pop-up" effects to be described.

In the illustrated construction, the reduced diameter of bolt portion 50*d* renders brake shoe 64 inoperative from the standpoint of producing friction braking effects on the bolt throughout the initial range of lid opening movements of between about zero and thirty degrees, whereas spring 60 is designed and adjusted to provide a counterbalancing torque in excess of gravity inducing lid torque during this range of lid movements. As a result, when the closed lid is released from physical constraint, such as may be afforded by a latch device, such as that shown in above mentioned U.S. Pat. No. 3,457,584, the lid is forced to "pop-up" and swing upwardly about the axis of hinge pin 20 under the action of spring force. When as a result of this lid movement bolt 50 is displaced sufficiently to bring bolt portion 50*a* into radial alignment with brake shoe 64, friction braking effects come into operation and thereafter cooperate with spring force effects to counterbalance the lid, during continued opening movements thereof.

While the present mechanism has been primarily described with reference to its use in a "pop-up" lid installation, it will be apparent that this mechanism may be modified for use in non-"pop-up" installations by the simple omission of bolt portion 50*d*.

I claim:

1. A lid counterbalance mechanism for a lid hingedly supported on a cabinet for vertical swinging movements between a closed position and open position about a horizontally disposed hinge axis, said mechanism being mounted within the confines of said cabinet and being connected to said lid by means coupled to said lid for conjunctive swinging movement about said hinge axis and coupling means carried by said means and extending therefrom into the confines of said cabinet for movement along an arcuate path about said hinge axis conjunctively with vertical swinging movements of said lid, said mechanism comprising:

a bracket mounted within said cabinet, said bracket having an opening extending therethrough and bearing means adjacent said opening for defining a tilt axis disposed essentially parallel to said hinge axis, a bolt extending through said opening in a direction transversely of said tilt axis, said bolt having first and second ends disposed adjacent opposite sides of said bracket, a connector fixed to said first end and connected to said coupling means for relative pivotal movement about an axis disposed parallel to said hinge and tilt axes, an abutment fixed to said second end, a friction brake assembly disposed concentrically of said bolt intermediate said bracket and said second end and in bearing engagement with said bearing means, a compression spring disposed concentrically of said bolt and bearing adjacent opposite ends thereof on said assembly and abutment, said spring tending to maintain said assembly in engagement with said bearing means and to push said second end of bolt through said opening for establishing a spring force induced counterbalance movement opposing gravity induced torque effects on said lid during movement thereof between said closed and open positions, and said assembly bearing in friction braking engagement with said bolt during at least a portion of said movements of said lid for opposing movements of said lid towards both said closed and open positions.

2. A mechanism according to claim 1, wherein said abutment is defined by an enlarged diameter end portion of a sleeve disposed concentrically intermediate said bolt and said spring, said end portion bearing on a nut threadably adjustably carried on said second end of said bolt.

3. A mechanism according to claim 1, wherein said bearing means comprises a pair of ears punched from said bracket and arranged adjacent horizontally opposite sides of said opening and facing towards said second end of said bolt.

4. A mechanism according to claim 1, wherein said first end of said bolt is sized for frictional braking engagement with said assembly when disposed in radial alignment therewith, said bolt is formed with an intermediate portion disposed between said first and second ends of said bolt, said intermediate portion is sized to prevent frictional braking engagement with said assembly when disposed in radial alignment therewith, and said intermediate portion and said first end being successively disposed in radial alignment with said assembly during movements of said lid from said closed position into said open position.

* * * * *